US007263983B2

(12) United States Patent
Maeda

(10) Patent No.: US 7,263,983 B2
(45) Date of Patent: Sep. 4, 2007

(54) EXHAUST GAS RECIRCULATION DEVICE

(75) Inventor: Kazuto Maeda, Nisshin (JP)

(73) Assignee: Denso Corporation (JP)

( * ) Notice: Subject to any disclaimer, the term of this patent is extended or adjusted under 35 U.S.C. 154(b) by 0 days.

(21) Appl. No.: 11/485,987

(22) Filed: Jul. 14, 2006

(65) Prior Publication Data

US 2007/0017491 A1 Jan. 25, 2007

(30) Foreign Application Priority Data

Jul. 20, 2005 (JP) ..... 2005-209704

(51) Int. Cl.
*F02M 25/07* (2006.01)
*F02B 47/08* (2006.01)

(52) U.S. Cl. ..... 123/568.21

(58) Field of Classification Search ..... 123/568.21, 123/568.23, 568.24, 568.26, 568.18
See application file for complete search history.

(56) References Cited

U.S. PATENT DOCUMENTS 4,198,940 A * 4/1980 Ishida ..... 123/568.2
4,475,524 A * 10/1984 Eckert et al. ..... 123/568.17
6,105,559 A * 8/2000 Stoltman ..... 123/568.19
6,135,415 A 10/2000 Kloda et al.
6,604,516 B1 * 8/2003 Krimmer et al. ..... 123/568.18

FOREIGN PATENT DOCUMENTS

EP 1 102 929 B1 7/1999
KR 2002-0055626 A 7/2002

OTHER PUBLICATIONS

Korean Intellectual Property Office Notice of Invitation to Submit Opinion issued Apr. 20, 2007 in corresponding Korean Application No. 10-2006-0067145, together with an English translation.

* cited by examiner

*Primary Examiner*—Mahmoud Gimie
(74) *Attorney, Agent, or Firm*—Nixon & Vanderhye PC

(57) ABSTRACT

An electric motor is placed on an upstream side of an exhaust gas recirculation passage of a housing in a direction that is parallel to an intake air flow direction. A first heat release part on a motor housing part of the housing is placed on an upstream side of an exhaust suction aperture in a direction of an intake air flow. A heat release of the electric motor is promoted by direct contact between a new intake air with much lower temperature than an EGR gas and the first heat release part of the motor housing part. Therefore, on the upstream side of the exhaust suction aperture in the direction of the intake air flow, the electric motor can be cooled by the new intake air. By utilizing the intake air suctioned into an inlet port of an engine, the electric motor and the like can be efficiently cooled.

19 Claims, 12 Drawing Sheets

EXHAUST GAS RECIRCULATION DEVICE

CROSS REFERENCE TO RELATED APPLICATION

This application is based on and incorporates herein by reference Japanese Patent Application No. 2005-209704 filed on Jul. 20, 2005.

BACKGROUND OF THE INVENTION

1. Field of the Invention

The present invention relates to an exhaust gas recirculation device, which has an exhaust gas recirculation control valve that opens and closes an exhaust gas recirculation passage, and, more particularly to the exhaust gas recirculation device, which employs a butterfly valve as a valve body of a motor-driven exhaust gas recirculation control valve.

2. Description of Related Art

An exhaust gas recirculation device, which decreases a maximum temperature of combustion, and which reduces harmful substances (e.g., nitrogen oxides) contained in an exhaust gas, has been known. In the above exhaust gas recirculation device, an exhaust recirculation gas (an EGR gas), which is a part of the exhaust gas that flows inside an exhaust pipe of an internal-combustion engine, is mixed into an intake air that flows inside an intake pipe. However, the recirculation (reflux) of the exhaust gas toward an intake side involves deteriorating an output of the internal-combustion engine and performance of the internal-combustion engine. Thus, a flow rate of the exhaust gas (an exhaust gas recirculation quantity: an EGR quantity) that recirculates from the exhaust pipe to the intake pipe needs to be adjusted. Accordingly, the exhaust gas recirculation device, in which an exhaust gas recirculation pipe (an EGR pipe) is provided with an exhaust gas recirculation control valve (an EGR control valve), has been publicly known. More specifically, with regard to the above exhaust gas recirculation device, the part of the exhaust gas of the internal-combustion engine recirculates from an exhaust path through the exhaust gas recirculation pipe into an intake path. Furthermore, the exhaust gas recirculation control valve adjusts an opening area of an exhaust gas recirculation passage, which is formed inside the exhaust gas recirculation pipe.

With reference to FIGS. 10 to 13, an example of structures of the above exhaust gas recirculation control valves will be described below. Rotational motion of an output shaft 102 of an electric motor 101 is transmitted to a valve shaft 104 via a speed reducing gear mechanism 103. A butterfly valve 105 is held and secured to an axial end of the valve shaft 104. By rotating the butterfly valve 105 about a rotational axis of the valve shaft 104, an exhaust gas recirculation passage 111, from which the EGR gas flows into an inside of a housing 106, is opened and closed (for example, refer to U.S. Pat. No. 6,135,415 and EP-1102929-B1). A mixing chamber 112, an air suction passage 110, and an air delivery passage 113 are included inside the housing 106. In the mixing chamber 112, the exhaust gas that flows from the exhaust gas recirculation passage 111 is mixed into the intake air, which is suctioned into the internal-combustion engine. The intake air flows through the air suction passage 110 into an inside of the mixing chamber 112. The intake air flows from the mixing chamber 112 through the air delivery passage 113 toward an inlet port of the internal-combustion engine. The air suction passage 110, the mixing chamber 112, and the air delivery passage 113 constitute a part of an intake path of the internal-combustion engine. Additionally, an EGR gas recirculation opening 114 opens in an inner wall surface of the mixing chamber 112. A valve bearing part 115 rotatably holds the valve shaft 104 via bearing parts 116,117.

The motor-driven exhaust gas recirculation control valve described above employs a water cooling structure or an inlet air cooling structure. The water cooling structure cools down the electric motor 101 and the like by utilizing engine coolant. The inlet air cooling structure cools down the electric motor 101 and the like by using the intake air that flows inside an intake air passage (the intake path). As a result, a temperature of the electric motor 101, the speed reducing gear mechanism 103, the valve shaft 104, or the valve bearing part 115 does not exceed an allowable heat-resistant temperature due to heat conduction from the EGR gas. In addition, the water cooling structure involves forming a coolant path in the housing 106, and drawing the engine coolant from a coolant circuit on a vehicle side. The inlet air cooling structure has a simple structure, and does not require the water cooling.

However, in the conventional motor-driven exhaust gas recirculation control valve, the electric motor 101, the speed reducing gear mechanism 103 and the valve shaft 104 are coaxial along an axis, which is perpendicular to a central axis of the intake path (i.e., the air suction passage 110, the mixing chamber 112, and the air delivery passage 113) of the internal-combustion engine, as shown in FIGS. 10 and 12. The high-temperature EGR gas flows from the exhaust gas recirculation passage 111 through the EGR gas recirculation opening 114 into the inside of the mixing chamber 112. The electric motor 101, the speed reducing gear mechanism 103, and the bearing part 116 are placed at or around a portion of the inner wall surface 119 of the mixing chamber 112, to which the high-temperature EGR gas is directed from the exhaust gas recirculation passage 111. The bearing part 117 is placed near the EGR gas recirculation opening 114.

For this reason, it is possible that the above high-temperature EGR gas contacts the inner wall surface 119 of the mixing chamber 112 before it is sufficiently mixed with the intake air that flows from the air suction passage 110 into the inside of the mixing chamber 112 to reduce its temperature. The contact of the high-temperature EGR gas with the inner wall surface 119 facilitates the conduction of heat of the high-temperature EGR gas to the electric motor 101, the speed reducing gear mechanism 103, and the bearing part 116 via the housing 106, thereby hindering efficient cooling of the electric motor 101 and the like.

SUMMARY OF THE INVENTION

The present invention addresses the above disadvantages. Thus, it is an objective of the present invention to provide an exhaust gas recirculation device, which can efficiently cool down a motor and the like, by utilizing an intake air that is suctioned into an internal-combustion engine.

To achieve the objective of the present invention, there is provided an exhaust gas recirculation device including a housing, a butterfly valve, and a motor. The housing has an exhaust gas recirculation passage, through which a part of an exhaust gas of an internal-combustion engine is recirculated from an exhaust side to an intake side of the engine. The housing includes a mixing chamber and an air suction passage. In the mixing chamber, the exhaust gas that is recirculated from the exhaust gas recirculation passage is mixed into an intake air that is suctioned into the internal-combustion engine. The intake air flows from the air suction passage into an interior of the mixing chamber. The air suction passage is formed on an upstream side of the mixing chamber in a direction of the intake air flow. The butterfly valve is movably received in the housing to open and close the exhaust gas recirculation passage. The motor generates driving force, which drives the butterfly valve. The motor is placed adjacent to an inner wall surface of the air suction passage so that the motor can be cooled by the intake air that flows through the air suction passage.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

A motor is placed upstream of a mixing chamber in a flow direction of an intake air, more specifically, near an inner wall surface of an air suction passage through which a new intake air with much lower temperature than an exhaust gas flows. As a result, the motor and motor peripheral parts (a rubber seal such as an oil seal and a packing) are efficiently cooled down using the intake air of an internal-combustion engine.

FIRST EMBODIMENT

Figure 1:
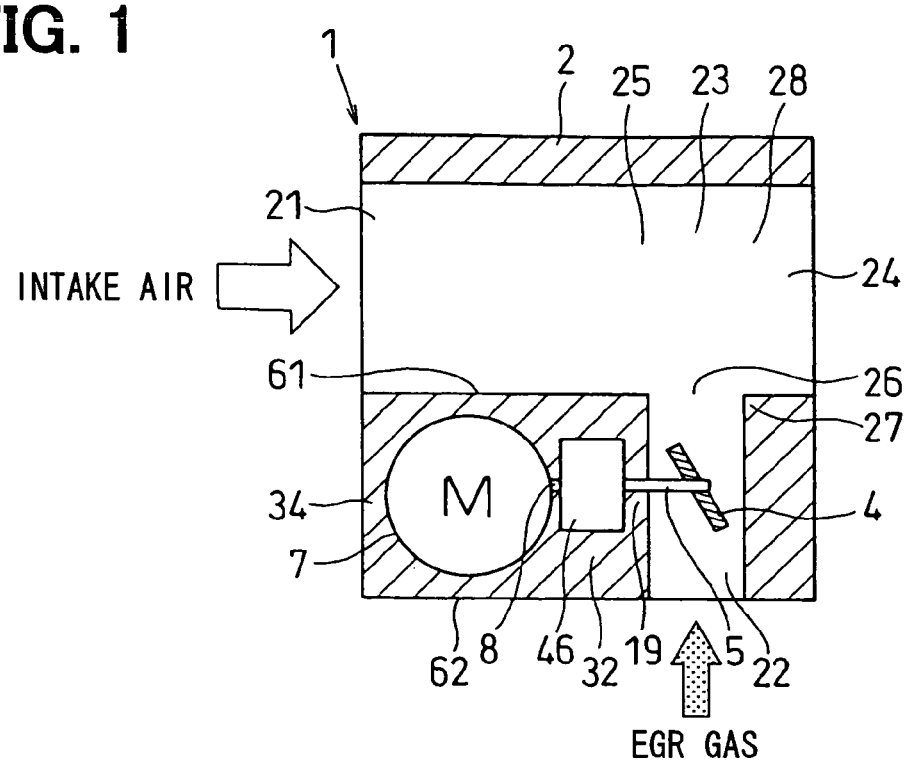
FIG. 1 is a schematic view that depicts a structure of an EGR control valve according to a first embodiment of the present invention.
Figure 10:
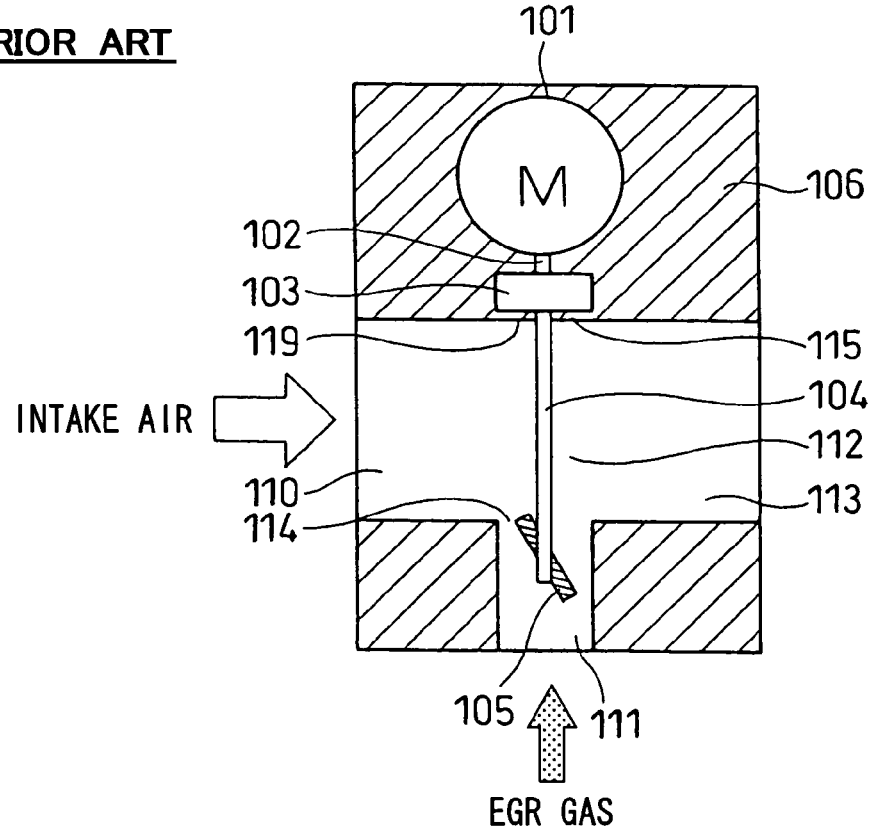
FIG. 10 PRIOR ART
FIG. 10 is a schematic view that depicts a structure of a previously proposed exhaust gas recirculation control valve.
Figure 2:
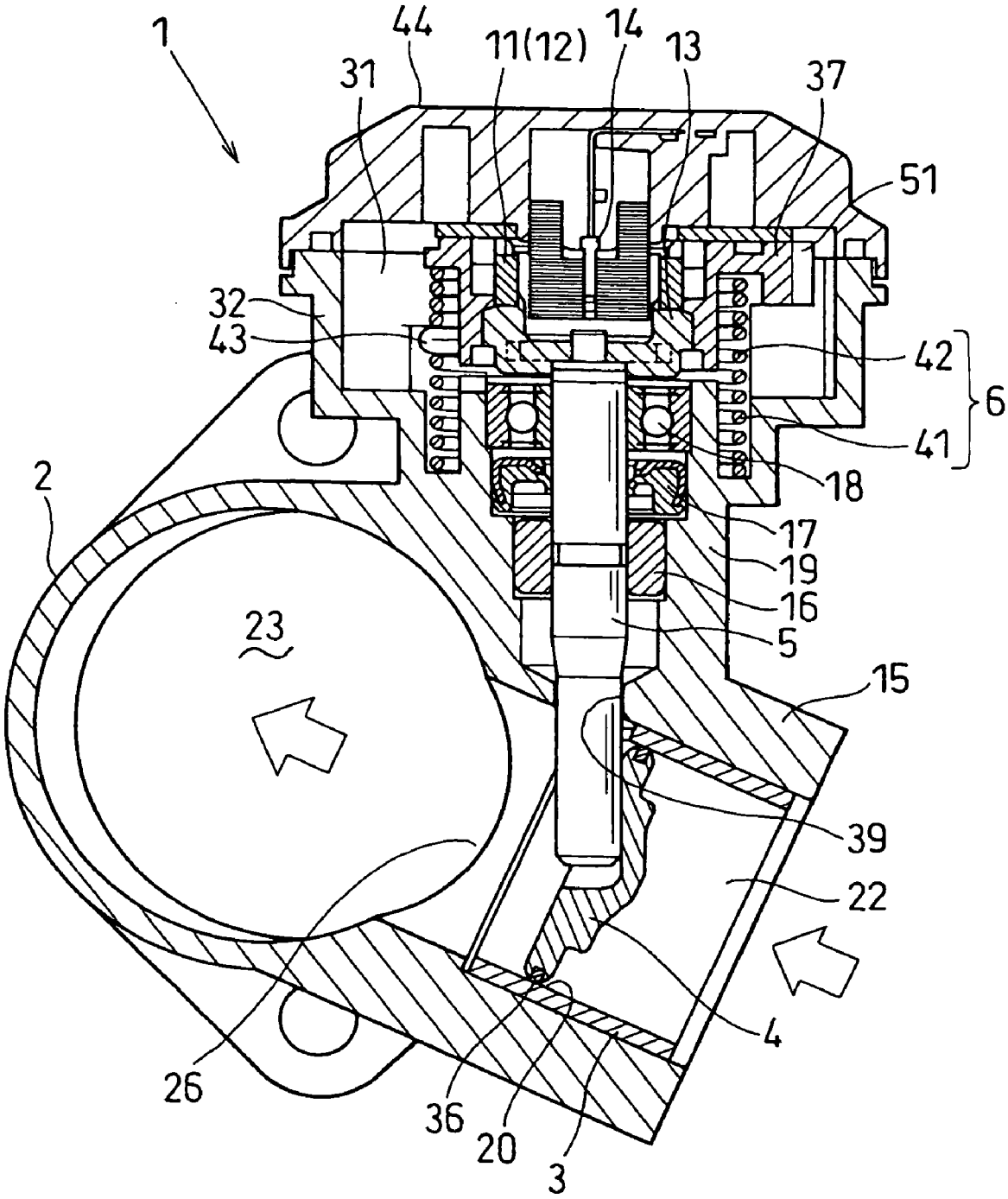
FIG. 2 is a cross-sectional view that depicts an overall structure of the EGR control valve according to the first embodiment.
Figure 3:
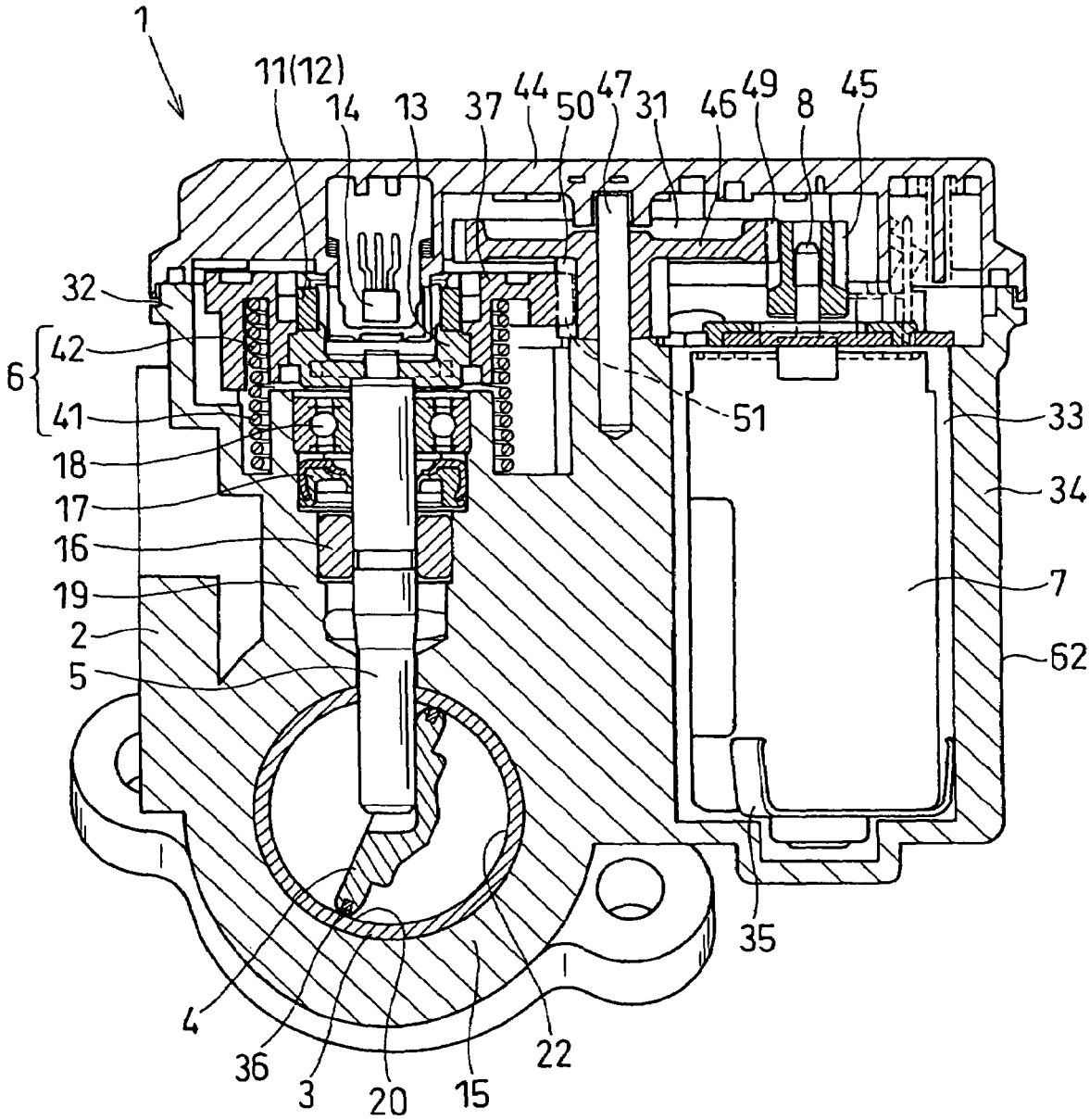
FIG. 3 is a cross-sectional view that depicts the overall structure of the EGR control valve according to the first embodiment.
Figure 4:
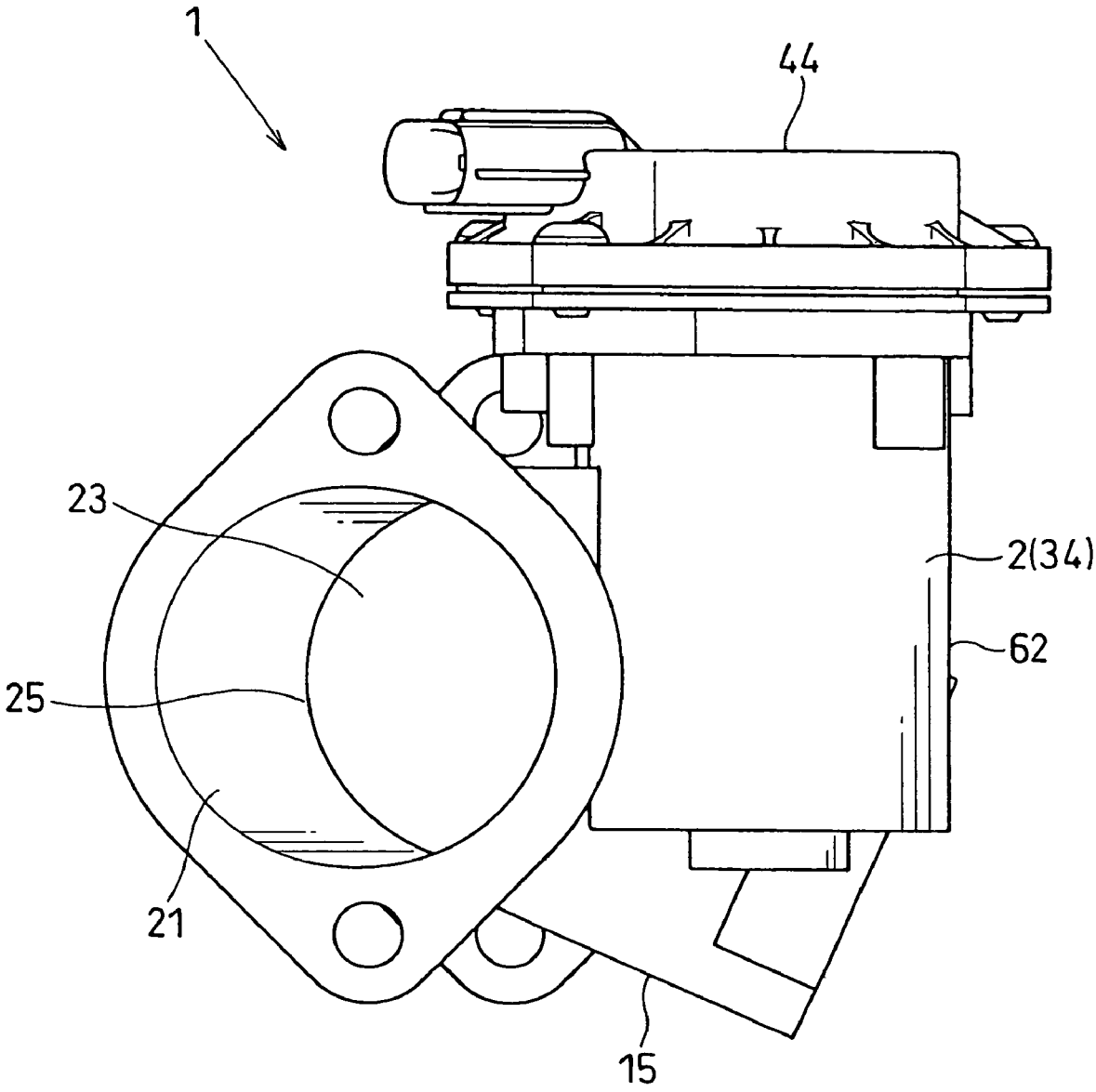
FIG. 4 is a front view that depicts the overall structure of the EGR control valve according to the first embodiment.
Figure 5:
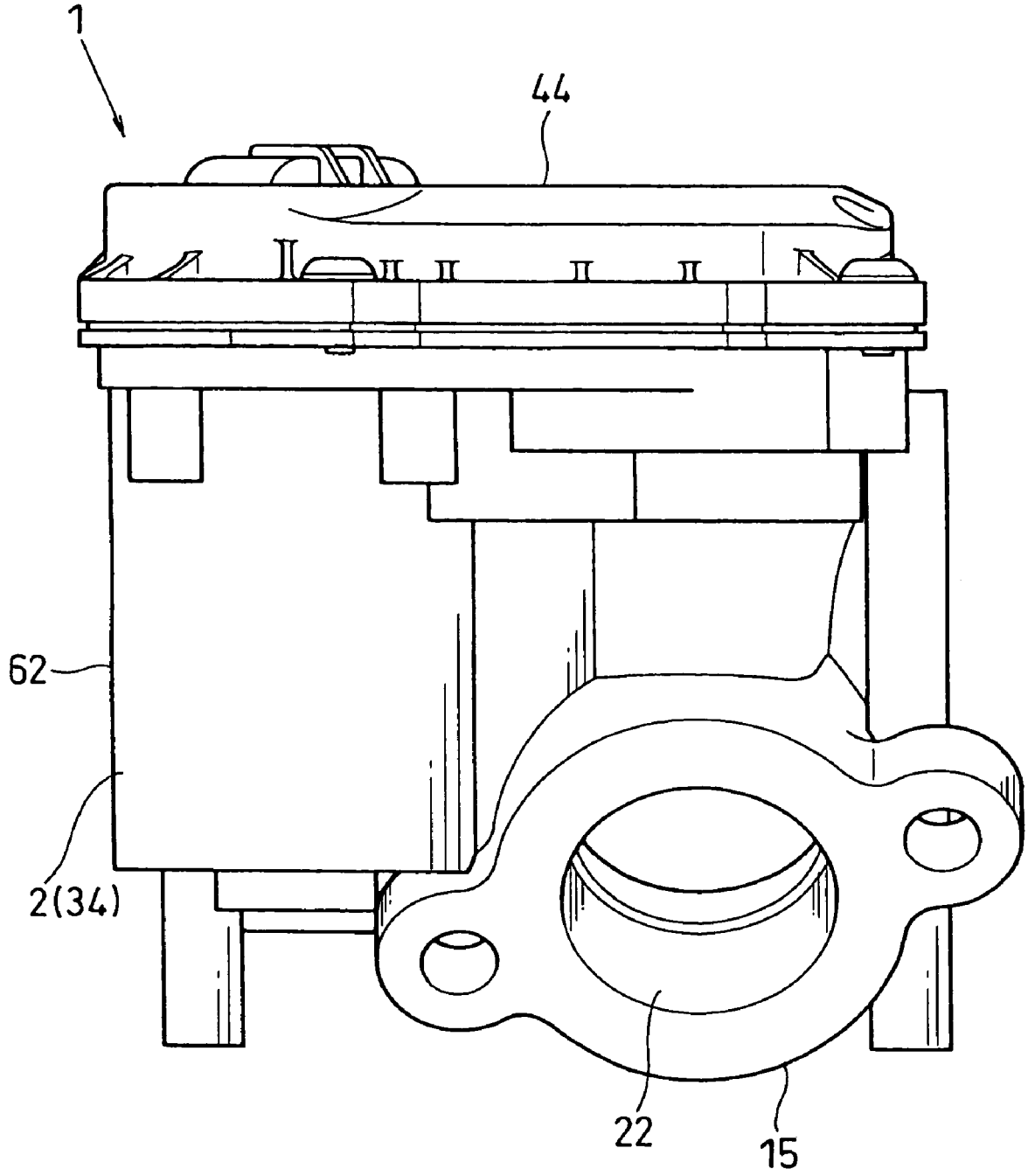
FIG. 5 is a side view that depicts the overall structure of the EGR control valve according to the first embodiment.
Figure 6:
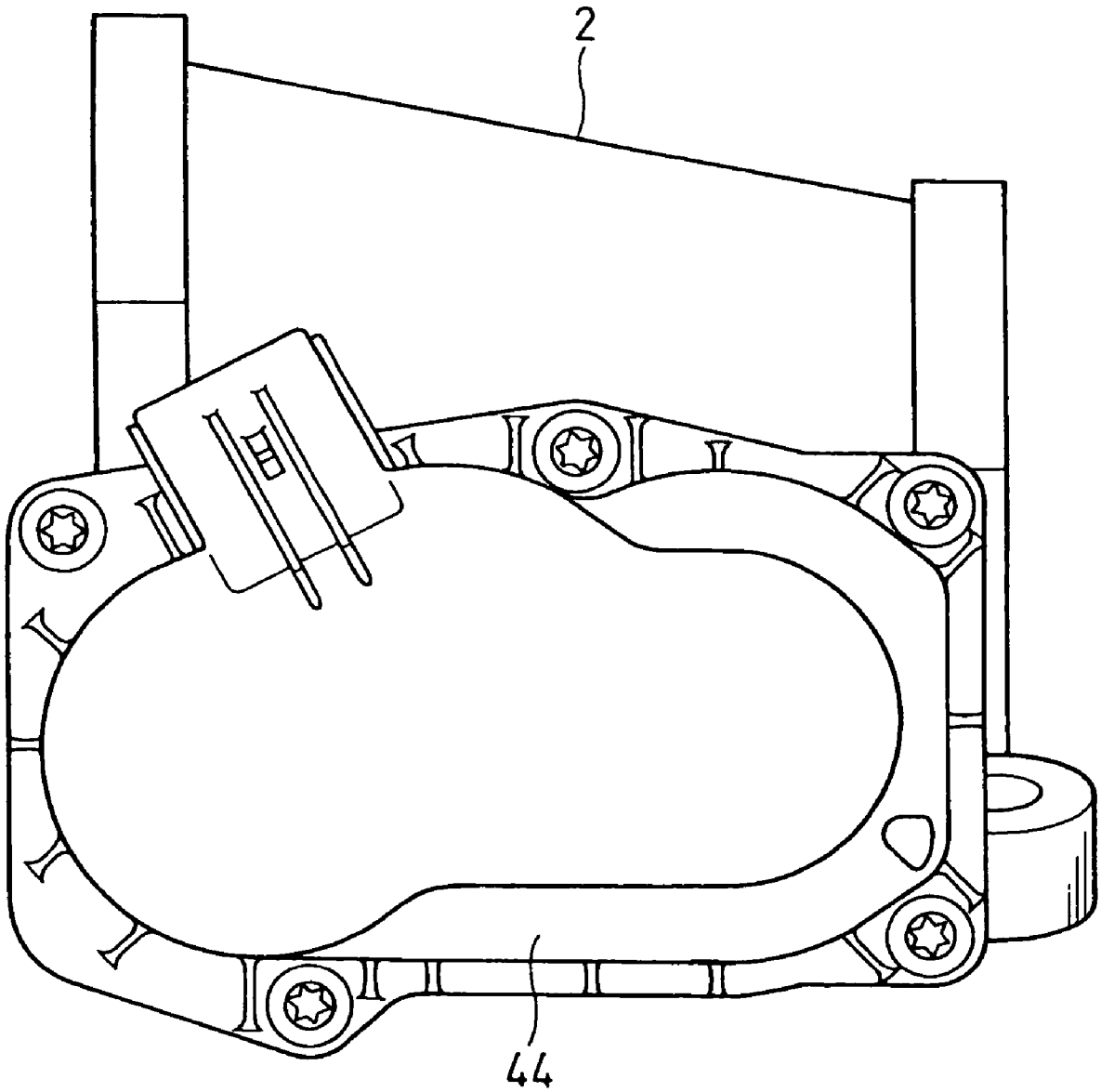
FIG. 6 is a plan view that depicts the overall structure of the EGR control valve according to the first embodiment.

FIGS. 1 to 6 show a first embodiment of the present invention. FIG. 1 shows a simplified structure of an exhaust gas recirculation control valve of the present embodiment. FIGS. 2 to 6 show an overall structure of the exhaust gas recirculation control valve.

The exhaust gas recirculation device of the present embodiment is employed in the internal-combustion engine (hereafter, referred to as an engine). The exhaust gas recirculation device is connected to an exhaust path provided in an exhaust pipe of the engine. The exhaust gas recirculation device has an exhaust gas recirculation pipe (not shown) to recirculate (reflux) a part of the exhaust gas (an exhaust recirculation gas: hereafter, referred to as an EGR gas) in an intake path provided in an intake pipe. Furthermore, the exhaust gas recirculation device also has the exhaust gas recirculation control valve (hereafter, referred to as an EGR control valve) 1, which continuously or gradually adjusts an EGR gas recirculation quantity (an EGR quantity) that flows through an exhaust gas recirculation passage provided in the exhaust gas recirculation pipe. An upstream end of the exhaust gas recirculation pipe is connected to an exhaust manifold of the exhaust pipe. A downstream end of the exhaust gas recirculation pipe is connected to the EGR control valve 1.

The EGR control valve 1 of the present embodiment includes a housing 2, a butterfly valve (i.e., a valve body of the EGR control valve 1) 4, a valve shaft 5, and a coil spring 6. The housing 2 forms a part of the intake pipe of the engine and a part of the exhaust gas recirculation pipe. The butterfly valve 4 is received in a cylindrical nozzle 3, which is fitted into and held by the housing 2. Furthermore, the butterfly valve 4 can open and close in the cylindrical nozzle 3. The valve shaft 5 is rotated integrally with the butterfly valve 4. The coil spring 6 biases the butterfly valve 4 in a valve opening or closing direction. A valve driving device that opens and closes the butterfly valve 4 includes an electric motor 7, a power transmission mechanism (in the present embodiment, a speed reducing gear mechanism) and the like. The electric motor 7 operates with electric power. The power transmission mechanism transmits rotational motion of a motor shaft 8 of the electric motor 7 to the valve shaft 5. The valve driving device is constructed in such a manner that the valve driving device (particularly the electric motor 7) is electrically controlled by an engine control unit (hereafter, referred to as an ECU).

The EGR control valve 1 includes a rotation angle detection device of a non-contact type. The rotation angle detection device converts a rotation angle (a valve opening degree) of the butterfly valve 4 into a corresponding electric signal, and outputs the electric signal, which indicates the valve opening degree, to the ECU. The rotation angle detection device includes a permanent magnet (a magnet) 11, a yoke (a magnetic body) 12, and an EGR quantity sensor. The magnet 11 as a source of a magnetic field is secured to an end of the valve shaft 5, which is opposite from the butterfly valve 4 in an axial direction of the valve shaft 5. The yoke 12 is magnetized by the magnet 11. The EGR quantity sensor cooperates with the magnet 11 and the yoke 12 to form a magnetic circuit. The magnet 11 and the yoke 12 magnetized thereby are fixed to an inner circumferential surface of a rotor 13 by means of an adhesive or the like. The EGR quantity sensor includes a Hall IC 14, which is disposed facing an inner circumferential surface of the yoke 12. The EGR quantity sensor detects inclusion of the EGR gas in an intake air that flows in the intake pipe. That is, the sensor detects the EGR quantity in the EGR gas in the intake pipe and sends an output to the ECU. The Hall IC 14 is an IC (an integrated circuit), in which a Hall element (a magnetism detecting element of a non-contact type) is integrated with an amplifier circuit. The Hall IC 14 outputs a voltage signal corresponding to a density of a magnetic flux that passes through the Hall IC 14. In addition, in place of the Hall IC 14, the Hall element, a magnetoresistive element can be used as the non-contact magnetism detecting element.

The ECU includes a microcomputer with a widely known configuration. The microcomputer includes a CPU, a storage device (a memory such as a ROM and a RAM), an input circuit, and an output circuit. The CPU performs control and processing, and the storage device stores various programs and data. The ECU electronically controls the opening degree of the butterfly valve 4 based on a control program stored in the memory when an ignition switch (not shown) is turned on (IG•ON). Furthermore, when the ignition switch is turned off (IG•OFF), the ECU terminates the above control operation, which is performed based on the control program stored in the memory. After A/D conversion through an A/D converter, a sensor signal sent from each sensor is inputted to the microcomputer of the ECU. The microcomputer is connected to the EGR quantity sensor, a crank angle sensor, an accelerator opening degree sensor, an air flow meter, and a coolant temperature sensor.

A first entrance side end opening of the housing 2 is connected to the intake pipe or to a throttle body on an air cleaner side. A second entrance side end opening of the housing 2 is connected to the exhaust gas recirculation pipe. An exit side end opening of the housing 2 is connected to an intake manifold or to a surge tank. The housing 2 is a device that rotatably holds the butterfly valve 4 inside the nozzle 3 in such a manner that the butterfly valve 4 is rotatable in a rotating direction from a fully closed position to a fully open position. The housing 2 is fixed to the exhaust gas recirculation pipe or to the intake pipe of the engine with fastening elements (not shown), such as bolts. The housing 2 is an aluminium alloy die casting and has a predetermined shape. A cylindrical nozzle receiving part 15, which receives the nozzle 3, is formed integrally with the housing 2. A valve bearing part 19 is formed integrally with the housing 2. The valve bearing part 19 rotatably supports the valve shaft 5 of the butterfly valve 4 through a bushing (a bearing part) 16, an oil seal (a sealant) 17 such as a rubber seal, and a ball bearing (a bearing part) 18. The nozzle 3 constitutes a part of the exhaust gas recirculation pipe. The nozzle 3 is a tube-like part that receives the butterfly valve 4, which can open and close inside the tube-like part. Specifically, the nozzle 3 is cylindrically formed out of a refractory material that resists high temperatures, for example, a stainless steel or the like. A valve seat 20, against which the butterfly valve 4 is seatable, is provided in a bore surface (an inner circumferential surface) of the nozzle 3.

The air suction passage (a first entrance side passage) 21, an exhaust gas recirculation passage (a second entrance side passage) 22, a mixing chamber 23, and an air delivery passage (an exit side passage) 24 are formed inside the housing 2. The intake air that is filtered through the air cleaner flows into the air suction passage 21 via the intake path of the intake pipe, which is located on an upstream side of the air suction passage 21. A part of the exhaust gas, which flows out of a respective combustion chamber of the engine, flows into the exhaust gas recirculation passage 22 via the exhaust gas recirculation passage on the exhaust gas recirculation pipe side. The low-temperature intake air, which flows through the air suction passage 21, and the high-temperature EGR gas, which flows through the exhaust gas recirculation passage 22, merge together and mix with each other in the mixing chamber 23. The intake air flows from the mixing chamber 23 through the air delivery passage 24 to a respective inlet port of the engine. The air suction passage 21, the mixing chamber 23, and the air delivery passage 24 are coaxially arranged, and constitute a part of the intake path of the intake pipe, which is communicated with the respective inlet port of the engine.

The exhaust gas recirculation passage 22 is provided inside the nozzle receiving part 15 in the present embodiment, and consequently, the exhaust gas recirculation passage 22 is formed inside the nozzle 3 as well as inside the housing 2 (integrally with which the nozzle receiving part 15 is formed). The exhaust gas recirculation passage 22 inside the nozzle 3 and the exhaust gas recirculation passage 22 inside the housing 2 are coaxially arranged. The intake air flows from the air suction passage 21 via a circular intake air suction aperture (a first entrance port) 25 into the mixing chamber 23. As well, the EGR gas flows from the exhaust gas recirculation passage 22 via a circular exhaust suction aperture (an exhaust gas recirculation opening, a second entrance port) 26 into the mixing chamber 23. The exhaust suction aperture 26 opens in an inner wall surface of the mixing chamber 23 in such a manner that a central axis of the exhaust suction aperture 26 is perpendicular to an axial direction of an average flow of the intake air. The mixing chamber 23 is a merging chamber, in which the EGR gas that recirculates from the exhaust gas recirculation passage 22 is mixed in the intake air that will be suctioned into the inlet port of the engine. The mixing chamber 23 is formed inside a three-way passage wall part (a T-passage wall part) 27 with T-shaped cross section. The three-way passage wall part 27 connects the air suction passage 21, the exhaust gas recirculation passage 22, and the air delivery passage 24. The intake air (or a mixture of the intake air and the EGR gas) flows from an inside of the mixing chamber 23 via an outlet port 28 into the air delivery passage 24.

A concave gear housing part 32 is formed integrally with the housing 2. A gear chamber 31 is provided inside the gear housing part 32. Each gear, which provides the speed reducing gear mechanism inside the gear chamber 31, is rotatably received in the gear housing part 32. A cylindrical motor housing part 34 is formed integrally with the housing 2. A motor receiving hole 33 is formed inside the motor housing part 34. The motor housing part 34 receives and holds the electric motor 7 inside the motor receiving hole 33. In the present embodiment, a damper spring (a leaf spring) 35 is provided between the electric motor 7 and the motor housing part 34 to improve the resistivity of the electric motor 7 against vibration. The gear housing part 32 and the motor housing part 34 will be described later in detail.

A seal ring 36 is held at an outer peripheral part of the butterfly valve 4. A seal contact surface of the seal ring 36 closely contacts a seat contact surface of the nozzle 3 (the valve seat 20) when the butterfly valve 4 is fully closed. Elastic deformation force of the seal ring 36 in a radial direction serves to enable this close contact between the two surfaces. As a result, an generally annular space between the bore surface of the nozzle 3 and an outside surface of the butterfly valve 4 is sealed. The butterfly valve 4 is formed into a circular disc body and is made of the refractory material (e.g., the stainless steel or the like) that resists high temperatures. The butterfly valve 4 is a butterfly rotary valve that controls the EGR quantity of the EGR gas, which is mixed with the intake air flowing through the intake pipe, and the butterfly valve 4 is held and secured to the axial end (i.e., a valve side end) of the valve shaft 5. While the engine is operating, the butterfly valve 4 is opened and is closed based on a control signal sent from the ECU within a rotational angle that ranges from the fully closed position to the fully open position. Accordingly, the butterfly valve 4 is the valve body (the valve body of the EGR control valve 1) that changes an opening cross sectional area of the exhaust gas recirculation pipe inside the nozzle 3 to control the EGR quantity of the EGR gas, which recirculates from an exhaust side to an intake side in the exhaust gas recirculation pipe.

The valve shaft 5 is formed approximately cylindrically out of the refractory material (e.g., the stainless steel or the like) that resists high temperatures. The valve shaft 5 is rotatably and slidably held in the valve bearing part 19 of the housing 2. A fixing portion is formed at the axial rear end (i.e., the end opposite from the valve side end) of the valve shaft 5. A valve side gear 37 and a valve gear plate are fixed to the fixing portion of the valve shaft 5 by crimping. The valve side gear 37 is a constituent element of the speed reducing gear mechanism. The valve gear plate is insert-molded in the rotor 13, which is one of components of the EGR quantity sensor. Similar to the valve shaft 5, the valve gear plate is formed in an generally toroidal shape out of the refractory material (e.g., the stainless steel or the like) that resists high temperatures. The axial distal end (the valve side end) of the valve shaft 5 extends through a shaft receiving hole 39 that penetrates through the nozzle receiving part 15 of the housing 2, and protrudes into an inside of the exhaust gas recirculation passage 22. The axial end of the valve shaft 5 is provided with a valve holding part. The butterfly valve 4 is fixed to the valve holding part of the valve shaft 5 by welding or the like.

The coil spring 6 is provided between an annular recess of the gear housing part 32 of the housing 2 and an annular recess of the valve side gear 37, which is formed integrally with the axial rear end of the valve shaft 5. The coil spring 6 is formed by combining a return spring 41 and a default spring 42. One end of the coil spring 6 (i.e., the valve side of the return spring 41) and the other end of the coil spring 6 (i.e., a cove side of the default spring 42) are convolved in opposite directions, respectively. The other end (i.e., the cover side) of the return spring 41 and the other end (i.e., the valve side) of the default spring 42 are joined together at a connecting portion. A U-hook part 43 is formed in the connecting portion, and when the engine stops, the U-hook part 43 is held by a fully closing side stopper member (not shown), which stops the butterfly valve 4 at the fully closed position. The return spring 41 is a first spring that biases the butterfly valve 4 in a direction back to the fully closed position from the fully open position. The default spring 42 is a second spring that biases the butterfly valve 4 in a direction back to the fully closed position from a position, at which the butterfly valve 4 moves past the fully closed position. In addition, the return spring 41 and the default spring 42 do not need to be joined together.

The electric motor 7 is received and held in the motor receiving hole 33 of the motor housing part 34 of the housing 2. Each gear of the speed reducing gear mechanism is rotatably received in the gear chamber 31 of the gear housing part 32 of the housing 2. A sensor cover 44 is attached to an exterior part of the housing 2 to close an opening of the motor housing part 34 and an opening of the gear housing part 32. The sensor cover 44 is made of a resin material (e.g., polybutylene terephthalate: PBT) that electrically insulates between adjacent terminals of the EGR quantity sensor. The sensor cover 44 is airtightly fixed to the exterior part of the housing 2 by a fastening screw, a clip, a locking part, and the like.

A direct-current (DC) motor is employed as the electric motor 7. The electric motor 7 is a brushless DC motor, which includes a rotor, a stator, and a motor housing. The rotor is formed integrally with the motor shaft 8. The motor shaft 8 protrudes from a forward end surface of the motor housing toward one side of an axial direction of rotation (i.e., a central axial direction of the motor shaft 8 of the electric motor 7). The stator, which is held by the motor housing, is placed facing an outer circumferential side of the rotor. The rotor includes a rotor core with a permanent magnet (a magnet). The stator includes a stator core, which is wound with an armature coil (an armature winding). Additionally, a brush DC motor and an alternating current (AC) motor such as three-phase induction motor can be substituted for the brushless DC motor. The electric motor 7 is received and held in the motor receiving hole 33. The forward end surface of the motor housing is fixed to the motor housing part 34 of the housing 2 by means of a fastening screw and the like.

A rotational speed of the motor shaft 8 of the electric motor 7 is reduced in a predetermined reducing ratio through the speed reducing gear mechanism. The speed reducing gear mechanism constitutes the power transmission mechanism, whereby a motor output shaft torque (driving force) of the electric motor 7 is transmitted to the valve shaft 5 of the butterfly valve 4. The speed reducing gear mechanism includes a pinion gear (a motor side gear) 45, an intermediate reduction gear 46, and the valve side gear 37. The pinion gear 45 is secured to an outer circumference of the motor shaft 8 of the electric motor 7. The intermediate reduction gear 46 is meshed with and is rotated with the pinion gear 45. The valve side gear 37 is meshed with and is rotated with the intermediate reduction gear 46. The intermediate reduction gear 46 is rotatably fitted into an outer circumference of a holding shaft 47, which is a rotation center of the intermediate reduction gear 46. The intermediate reduction gear 46 includes a large diameter gear 49 and a small diameter gear 50. The large diameter gear 49 meshes with the pinion gear 45. The small diameter gear 50 meshes with the valve side gear 37. The valve side gear 37 is integrally molded from a resin material (e.g., polybutylene terephthalate: PBT) in a predetermined generally toroidal shape. A gear part 51 is formed integrally with the valve side gear 37 on an outer circumferential surface thereof. The gear part 51 meshes with the small diameter gear 50 of the intermediate reduction gear 46. The rotor 13 is integrally molded from a non-metal material (a resin material) on an inner diameter side of the valve side gear 37.

As shown in FIG. 1, the motor shaft 8 of the electric motor 7, the speed reducing gear mechanism, and the valve shaft 5 (that constitute the valve driving device) are arranged one after another in a direction that is parallel to the flow direction of the intake air, which flows through the intake path (the air suction passage 21, the mixing chamber 23, and the air delivery passage 24) inside the housing 2. As a result, the electric motor 7, the speed reducing gear mechanism, and the valve bearing part 19 can be efficiently cooled down by utilizing the intake air that is suctioned into the engine. The electric motor 7, the speed reducing gear mechanism, and the valve shaft 5 are received in the inside (the motor housing part 34, the gear housing part 32, the valve bearing part 19, and the nozzle receiving part 15) of the housing 2. More specifically, they are received inside the housing 2 from an upstream side to a downstream side of the intake air flow direction in the order of the electric motor 7, the speed reducing gear mechanism, and the valve shaft 5. A first heat release part 61 and a second heat release part 62 are formed on an outside diameter surface (an outer circumferential surface) of the electric motor 7, or rather, on the outside diameter surface (a cylindrical surface) of the motor housing part 34, which receives the electric motor 7. The first heat release part 61 is exposed to the intake air that flows inside the housing 2 so that the heat can be released into the intake air. The second heat release part 62 is exposed to air that flows outside the housing 2 so that the heat can be released into the outside air.

The first heat release part 61 is a first heat release surface that is exposed on an inner wall surface of the air suction passage 21. The heat generated from the electric motor 7 can be released into the intake air that flows through the air suction passage 21 of the housing 2. In the housing 2, the motor receiving hole 33 of the motor housing part 34 is positioned on an upstream side (an air cleaner side) of the exhaust gas recirculation passage 22 in the direction parallel to the flow direction of the intake air. As a result, the first heat release part 61 on the outside diameter surface of the motor housing part 34 is placed on an upstream side (the air cleaner side) of the exhaust suction aperture 26 that opens in an inner wall surface of the mixing chamber 23 in the direction parallel to the flow direction of the intake air. Therefore, the first heat release part 61 is placed on the upstream side of the exhaust gas recirculation passage 22 in the direction parallel to the flow direction of the intake air. In addition, the first heat release part (the first heat release surface) that is exposed on the inner wall surface of the air suction passage 21 can also be formed on an inner wall surface of the gear housing part 32 and/or on an inner wall surface of the nozzle receiving part 15. As a consequence, the heat generated from the electric motor 7 can be released into the intake air that flows through the air suction passage 21 of the housing 2.

The second heat release part 62 is placed along the outer circumference of the motor housing (or a cylindrical yoke) of the electric motor 7 to form a part of the cylindrical surface of the motor housing part 34. The second heat release part 62 is a second heat release surface that is exposed on the outer wall surface of the motor housing part 34 of the housing 2 so that the heat generated from the electric motor 7 can be released into the air (e.g., outside air such as a traveling wind) that flows along the outer wall surface of the motor housing part 34 of the housing 2. Additionally, the second heat release part (the second heat release surface) that is exposed on the outer wall surface of the motor housing part 34 of the housing 2 can also be formed on an outer wall surface of the gear housing part 32 and/or on a cylindrical surface (an outer wall surface) of the valve bearing part 19. Consequently, the heat generated from the electric motor 7 can be released into the outside air that flows along the outer wall surface of the housing 2. Furthermore, the outer diameter surface (the outer peripheral surface) of the motor housing (or the cylindrical yoke) of the electric motor 7 can be brought into close contact with a bore surface (an inner circumferential surface) of the motor housing part 34. As a result, the heat generated from the electric motor 7 can be even more efficiently conducted to the motor housing part 34 of the housing 2

With reference to FIGS. 1 to 6, and 10, the operation of the exhaust gas recirculation device of the first embodiment will be briefly described below.

When an intake valve of the respective inlet port of a cylinder head of the engine opens after starting the engine, the intake air, which is filtered by the air cleaner, is distributed to the intake manifold leading to each cylinder through the intake pipe, the throttle body, and the interior (including, the air suction passage 21, the intake air suction aperture 25, the mixing chamber 23, the outlet port 28, and the air delivery passage 24 in this order) of the housing 2 of the EGR control valve 1. Then, the intake air is suctioned into each cylinder of the engine. The air is compressed in the engine until the air temperature becomes higher than a temperature at which fuel burns. Combustion is made when the fuel is sprayed into the above air. A combustion gas, which has been combusted in each cylinder, is exhausted from an exhaust port of the cylinder head, and then is exhausted via the exhaust manifold and the exhaust pipe.

The motor shaft 8 of the electric motor 7 rotates when the electric motor 7 is powered by the ECU, such that the butterfly valve 4 of the EGR control valve 1 opens at the predetermined valve opening degree (at the predetermined rotation angle). When the motor shaft 8 rotates, the pinion gear 45 rotates, and the driving force (the motor output shaft torque) of the electric motor 7 is transmitted to the intermediate reduction gear 46. When the intermediate reduction gear 46 rotates, the valve side gear 37, which has the gear part 51 that is meshed with the intermediate reduction gear 46, is rotated. Accordingly, the valve shaft 5, which is formed integrally with the valve side gear 37, rotates by the predetermined rotation angle. Then, the butterfly valve 4 is rotated (driven to open the valve) in the direction (in the valve opening direction) from the fully closed position to the fully open position.

Then, the part of the exhaust gas (the EGR gas) of the engine flows into the inside of the exhaust gas recirculation passage 22 of the housing 2 via the exhaust gas recirculation passage in the exhaust gas recirculation pipe from the exhaust path provided in the exhaust pipe of the engine. The EGR gas flows into the inside of the mixing chamber 23 through the exhaust suction aperture 26 from the exhaust gas recirculation passage 22 of the housing 2. The EGR gas is mixed with the intake air that flows into the interior of the mixing chamber 23 through the intake air suction aperture 25 from the air suction passage 21 of the housing 2. The EGR quantity of the EGR gas is feedback-controlled to keep the quantity at a predetermined level, based on a detection signal from an intake air quantity sensor (an air flow meter), from an intake temperature sensor, and from the EGR quantity sensor. Thus, in order to reduce emissions, the valve opening degree of the butterfly valve 4 of the EGR control valve 1 is linearly controlled to retain the predetermined EGR quantity, which is set for each operating state of the engine. The EGR gas recirculates into an inside of the housing 2 via the exhaust gas recirculation pipe from the exhaust pipe. Then the intake air, which will be suctioned into each cylinder of the engine via the intake pipe, is mixed with the above EGR gas.

An intake integral cooling structure is employed in the exhaust gas recirculation device of the first embodiment. The intake integral cooling structure cools down the parts (e.g., the electric motor 7, the speed reducing gear mechanism, and the bushing 16 and the oil seal 17 provided in the valve bearing part 19), which are included in the housing 2 of the EGR control valve 1. The parts are cooled down by utilizing the intake air (the intake) that is suctioned into the inlet port of the engine. To enable the cooling by utilizing the intake air that flows through the air suction passage 21 of the housing 2 of the EGR control valve 1, the electric motor 7 is placed near the inner wall surface of the air suction passage 21. More specifically, the electric motor 7 is not placed at or around a portion of the inner wall surface of the mixing chamber 23, to which the high-temperature EGR gas that flows into the inside (the mixing chamber 23) of the housing 2 through the exhaust suction aperture 26 is directed (see FIG. 10). Instead, the electric motor 7 is placed on the upstream side (the air cleaner side) of the exhaust gas recirculation passage 22 in the direction parallel to the flow direction of the intake air. As a result, the first heat release part 61 of the motor housing part 34 is positioned on the upstream side (the air cleaner side) of the exhaust suction aperture 26 that opens in the inner wall surface of the mixing chamber 23 in the direction parallel to the flow direction of the intake air (see FIG. 1).

The electric motor 7 is received and held in the motor receiving hole 33, which is formed in the motor housing part 34. The heat generated from the electric motor 7 is conducted to the cylindrical portion of the motor housing part 34. On an upstream side of the mixing chamber 23 in the direction parallel to the flow direction of the intake air, the first heat release part 61 of the motor housing part 34 is exposed to an inside of the air suction passage 21. The new intake air flows into the inside of the air suction passage 21 from the air cleaner side. The heat release of the electric motor 7 is promoted by direct contact between the above new intake air having much lower temperature than the EGR gas and the first heat release part 61 of the motor housing part 34. Therefore, on the upstream side (the air cleaner side) of the exhaust suction aperture 26 in the direction parallel to the flow direction of the intake air, the electric motor 7 can be cooled down by the new intake air. That is, by utilizing the intake air that is suctioned into the inlet port of the engine, the electric motor 7 and the like can be efficiently cooled down. Additionally, the high-temperature EGR gas flows from the exhaust gas recirculation passage 22 through the exhaust suction aperture 26 into the inside (the mixing chamber 23) of the housing 2. Yet, it becomes difficult for the heat of this EGR gas to be conducted to the electric motor 7 and to the electric motor peripheral parts (e.g., the oil seal 17) via the motor housing part 34 of the housing 2 and/or via the valve bearing part 19, thereby preventing a heat stress on the electric motor 7 and on the electric motor peripheral parts (e.g., the oil seal 17).

The second heat release part 62 of the motor housing part 34 is exposed on the outer wall surface of the housing 2. The outside air with much lower temperature than the EGR gas flows along the outer wall surface of the housing 2. By the direct contact between this outside air and the second heat release part 62 of the motor housing part 34, the heat release of the electric motor 7 is further promoted. Hence, the electric motor 7 can be cooled down by utilizing the air (the outside air) that flows near the outer wall surface of the housing 2 as well as the new intake air, which flows from the air cleaner side into an inside of the air suction passage 21. That is, the heat generated from the electric motor 7 can be efficiently released through the first heat release part 61 not only into the intake air that flows through the air suction passage 21 of the housing 2, but into the air (the outside air) that flows near the outer wall surface of the housing 2 through the second heat release part 62. As a result, the electric motor 7 and the like can be even more efficiently cooled down, thereby achieving fine heat release performance. Consequently, performance degradation of the electric motor 7 due to overheat of the electric motor 7 can be prevented. Furthermore, the electric motor's better performance leads to an improved quality of the valve driving device including the electric motor 7.

SECOND EMBODIMENT

Figure 7A:
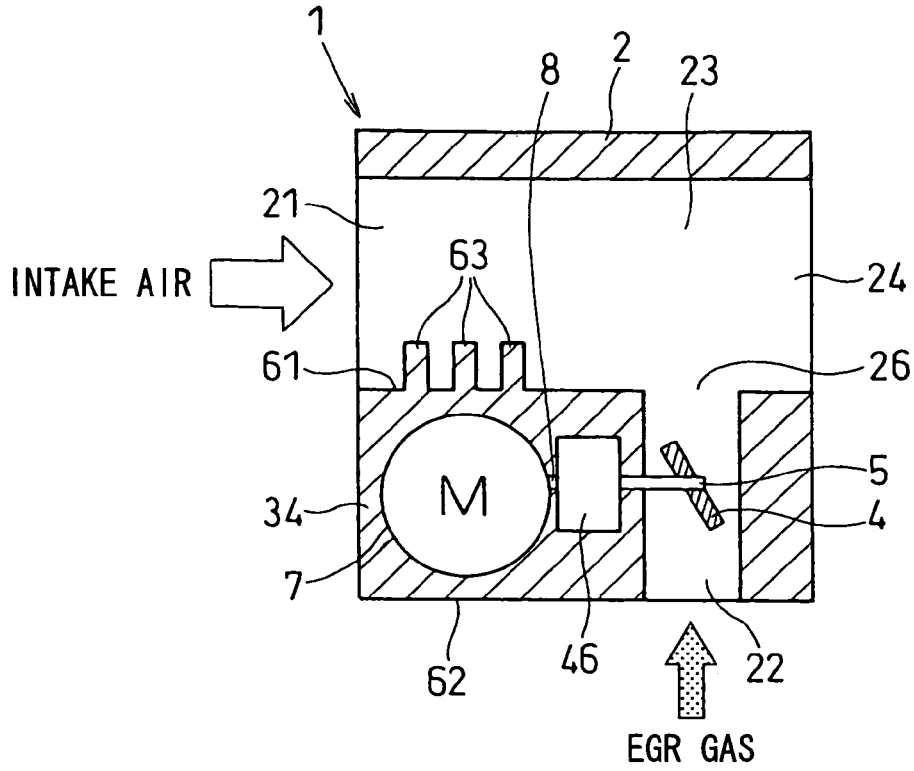
FIGS. 7A and 7B are schematic views that depict structures of EGR control valves according to a second embodiment of the present invention.
Figure 7B:
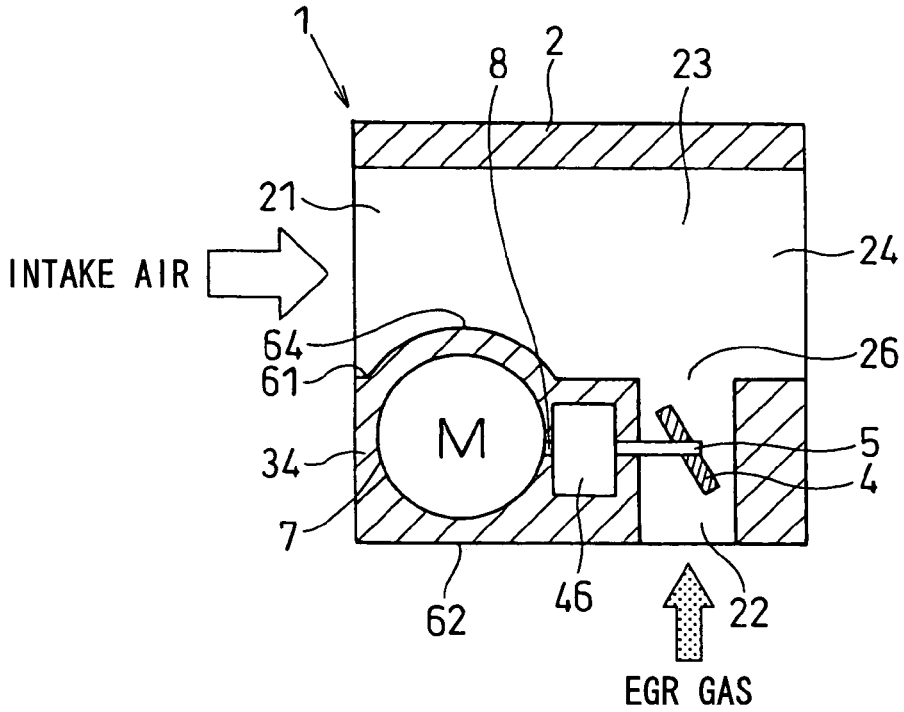

FIGS. 7A and 7B show a second embodiment of the present invention. FIGS. 7A and 7B are schematic views that depict structures of the EGR control valves of the present embodiment.

As shown in FIG. 7A, with respect to the EGR control valve 1 of the present embodiment, a plurality of cooling fins 63 is formed on the motor housing part 34 of the housing 2 and/or on the first heat release part 61 of the electric motor 7. The cooling fins 63 protrude from the inner wall surface of the air suction passage 21 toward a central axial side of the air suction passage 21. As well, a convex part 64 is formed on the motor housing part 34 of the housing 2 and/or on the first heat release part 61 of the electric motor 7 as shown in FIG. 7B. The convex part 64 protrudes toward the central axial side of the air suction passage 21. Furthermore, the convex part 64 is placed along the outer circumference of the motor housing (or the cylindrical yoke) of the electric motor 7 to form the part of the cylindrical surface of the motor housing. In each case above, an area of its contact surface with the new intake air, which flows from the air cleaner side into the inside of the air suction passage 21, and thus which has much lower temperature than the EGR gas, increases. That is, a heat release area of the first heat release part 61 increases, so that the electric motor 7 and the like can be even more efficiently cooled down.

THIRD EMBODIMENT

Figure 8A:
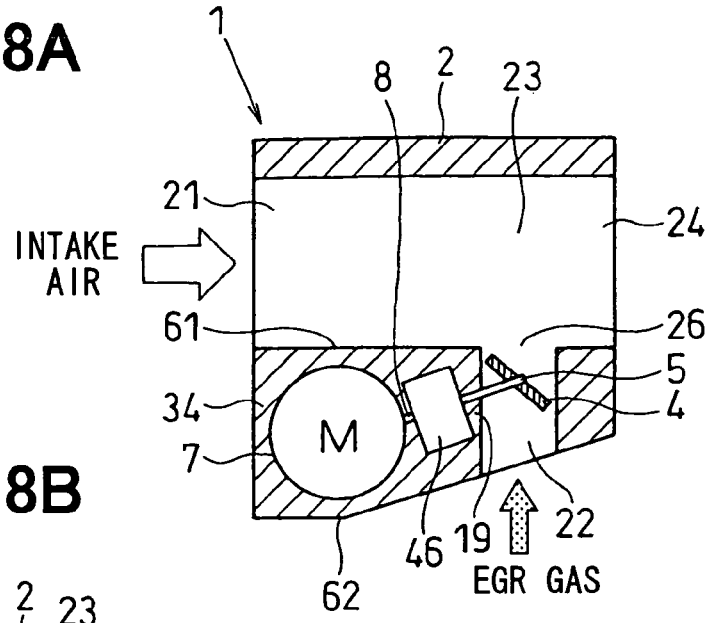
FIGS. 8A, 8B, and 8C are schematic views that depict structures of EGR control valves according to a third embodiment of the present invention.
Figure 8B:
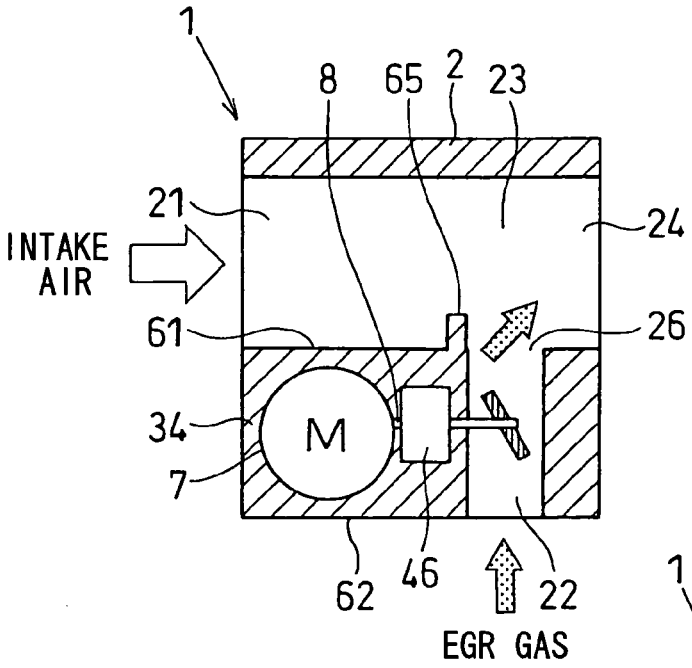
Figure 8C:
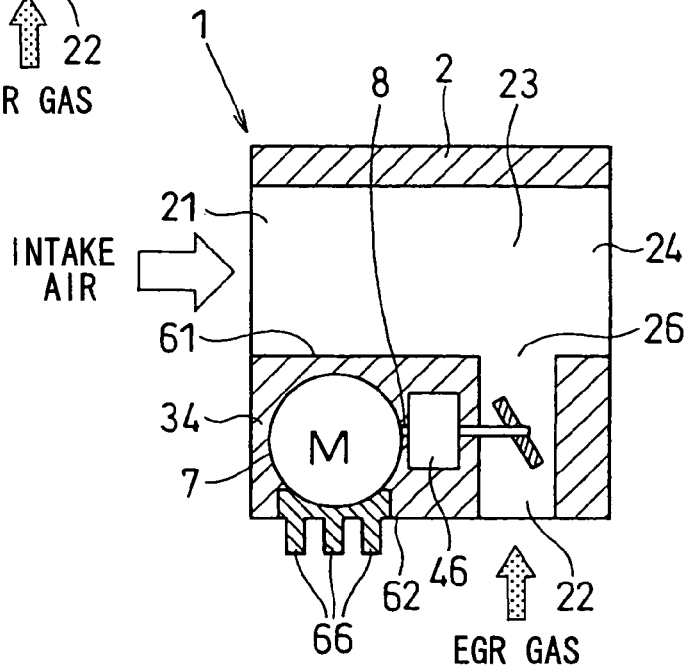

FIGS. 8A to 8C show a third embodiment of the present invention. FIGS. 8A to 8C are schematic views that depict structures of the EGR control valves of the present embodiment.

As shown in FIG. 8A, with respect to the EGR control valve 1 of the present embodiment, the valve bearing part 19 of the housing 2 and the valve shaft 5 are placed closer to the air suction passage 21 and to the mixing chamber 23 than the motor shaft 8 of the electric motor 7. By virtue of this arrangement, it becomes difficult for the heat of the high-temperature EGR gas, which flows into the interior (the mixing chamber 23) of the housing 2 through the exhaust suction aperture 26, to be conducted to the valve bearing part side of the housing 2. Thus, an influence of the heat on the valve bearing part 19 of the housing 2 can be reduced. Particularly when the oil seal 17 is employed as the peripheral part of the electric motor between an inner circumferential surface of the valve bearing part 19 of the housing 2 and an outer circumferential surface of the valve shaft 5, temperatures of the oil seal 17 and its periphery can be prevented from exceeding a heat-resistant temperature of the oil seal. As a result, a deterioration (a heat deterioration) of the oil seal due to the heat of the high-temperature EGR gas can be minimized. In addition, the oil seal 17 such as the rubber seal prevents lubricating oil, which lubricates the ball bearing (the bearing part) 18 of the valve bearing part 19, from flowing out toward the butterfly valve side or toward the exhaust gas recirculation passage side.

Moreover, with respect to the EGR control valve 1 of the present embodiment, a weir 65 is formed on an opening edge of the exhaust suction aperture 26 of the housing 2 as shown in FIG. 8B. The weir 65 is located on the upstream side of the exhaust suction aperture 26 in the direction parallel to the flow direction of the intake air to prevent a backflow of the EGR gas toward the air suction passage side. Furthermore, the weir 65 protrudes from the opening edge of the exhaust suction aperture 26 toward the central axial side of the air suction passage 21. In this case above, the EGR gas, which flows from the exhaust gas recirculation passage 22 through the exhaust suction aperture 26 into the interior of the mixing chamber 23, can be prevented from flowing back toward the air suction passage side. Consequently, a temperature rise of the first heat release part 61 of the motor housing part 34 due to the heat of the EGR gas can be restrained, thereby restraining a temperature rise of the electric motor 7 and its periphery.

As well, with respect to the EGR control valve 1 of the present embodiment, a plurality of cooling fins 66 is formed on the motor housing part 34 of the housing 2 and/or on the second heat release part 62 of the electric motor 7 as shown in FIG. 8C. The cooling fins 66 protrude from the cylindrical surface (the outer wall surface) of the motor housing part 34 of the housing 2 toward a side that is opposite from the air suction passage side. In this case, an area of a contact surface with the outside air that flows along the cylindrical surface of the motor housing part 34 of the housing 2 increases, and therefore a heat release area of the second heat release part 62 increases. Accordingly, the electric motor 7 and the like can be even more efficiently cooled down.

FOURTH EMBODIMENT

Figure 9A:
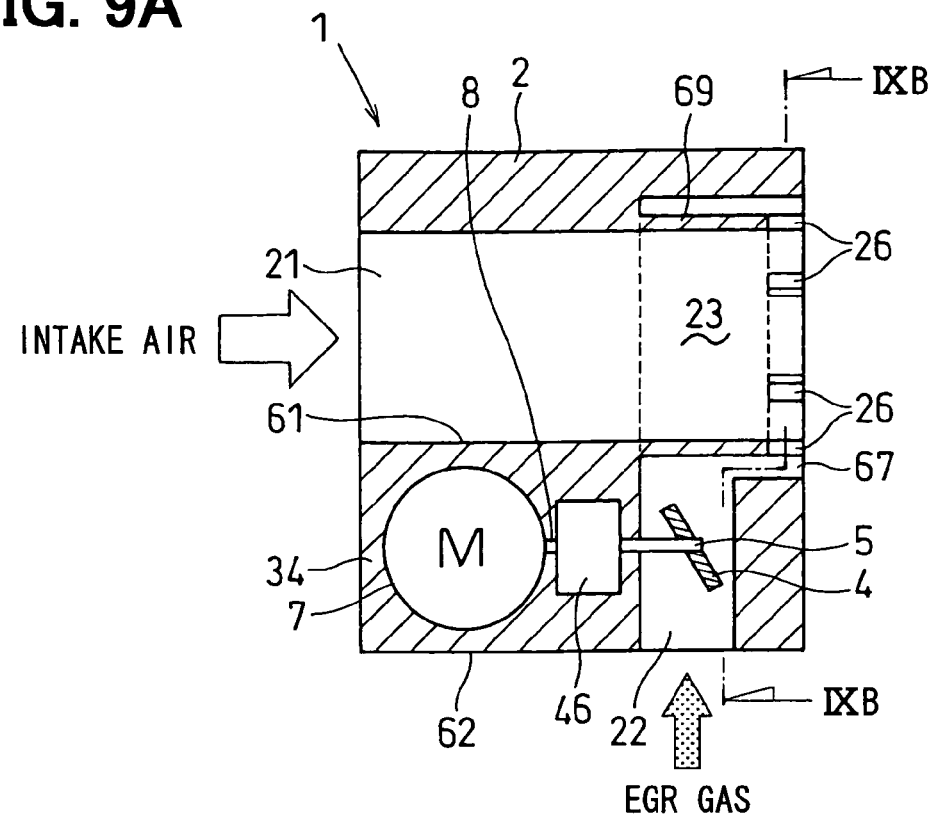
FIG. 9A is a schematic view that depicts a structure of an EGR control valve according to a fourth embodiment of the present invention.
Figure 9B:
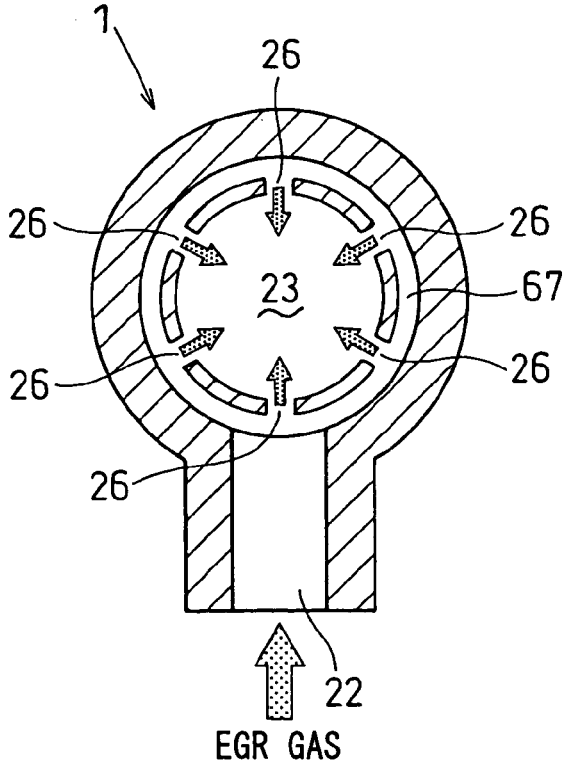
FIG. 9B is a cross-sectional view in the FIG. 9A taken along a line IXB-IXB.
Figure 11:
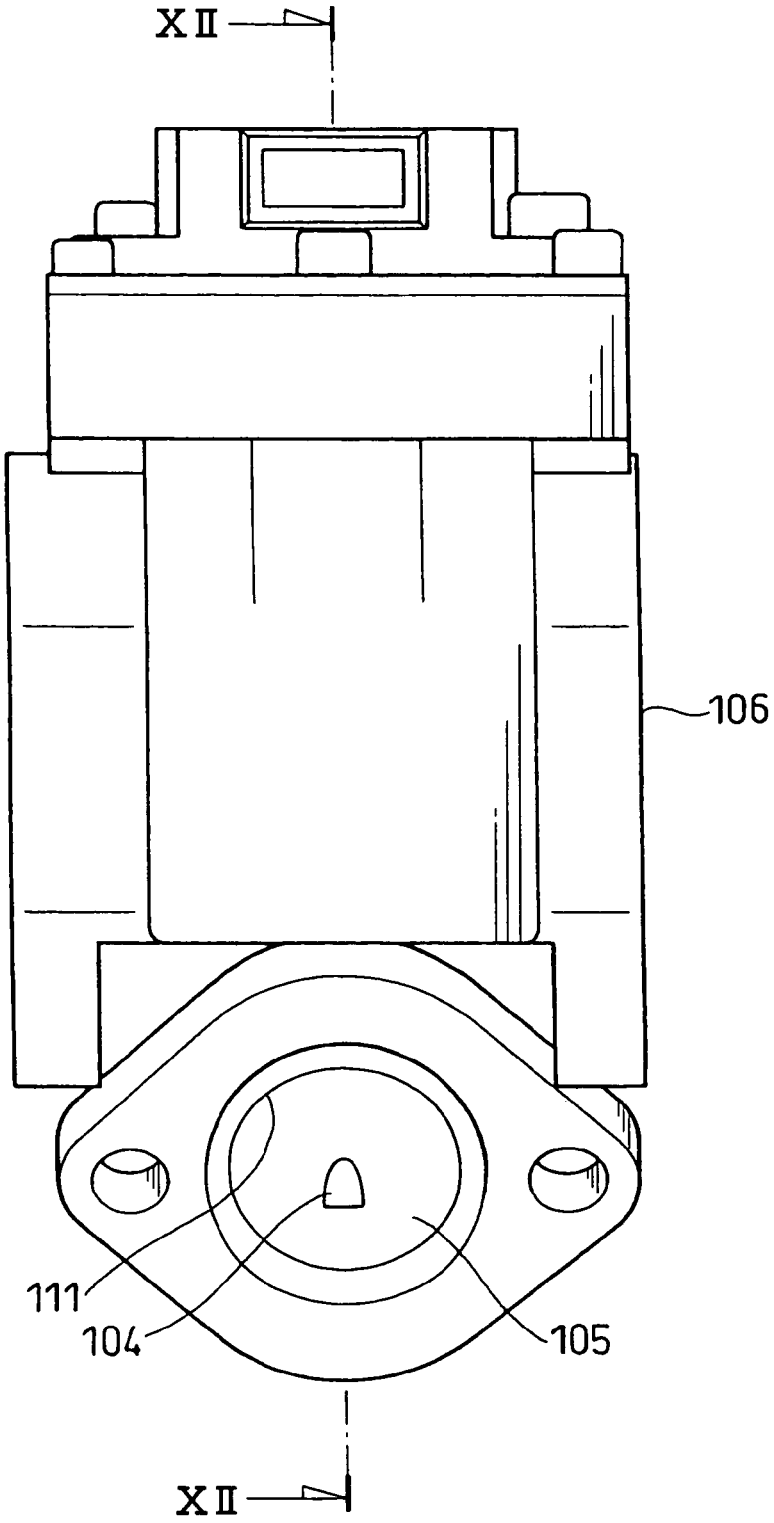
FIG. 11 PRIOR ART
FIG. 11 is a side view that depicts an overall structure of the previously proposed exhaust gas recirculation control valve.
Figure 12:
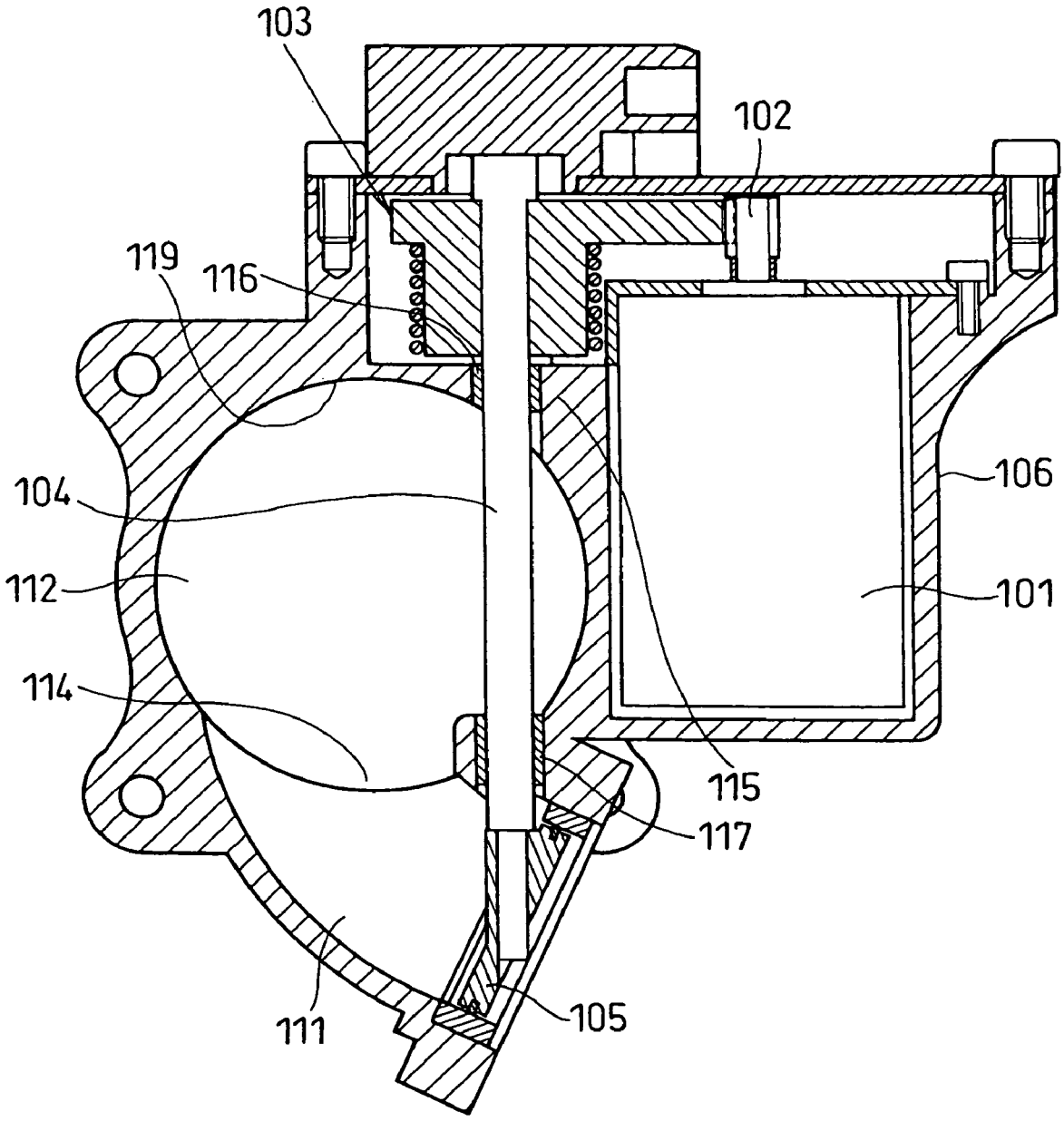
FIG. 12 PRIOR ART
FIG. 12 is a cross-sectional view taken along a line XII-XII in FIG. 11.
Figure 13:
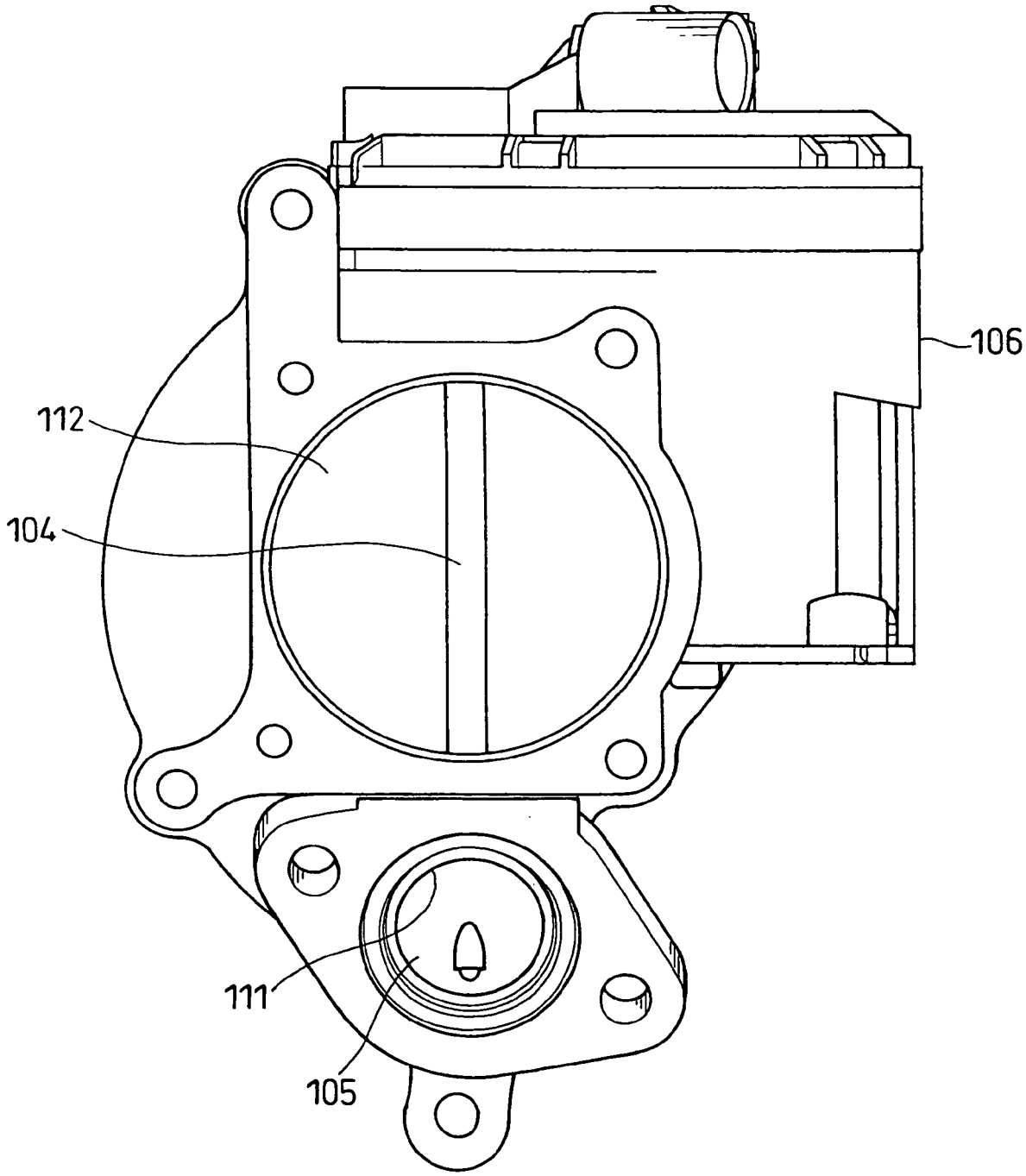
FIG. 13 PRIOR ART
FIG. 13 is a front view that depicts the overall structure of the previously proposed exhaust gas recirculation control valve.

FIGS. 9A and 9B show a fourth embodiment of the present invention. FIGS. 9A and 9B are schematic views that depict structures of the EGR control valves of the present embodiment.

With respect to the EGR control valve 1 of the present embodiment, a cylindrical partition wall part 69, which separates the cylindrical exhaust gas recirculation passage 67 from the mixing chamber 23, is formed near the inner wall surface of the mixing chamber 23 of the housing 2 as shown in FIGS. 9A and 9B. A plurality of exhaust suction apertures 26 opens in an inner circumferential surface of the partition wall part 69 (i.e., on the inner wall surface of the mixing chamber 23). The EGR gas flows from the exhaust gas recirculation passage 22 through the exhaust suction apertures 26 into the interior of the mixing chamber 23. The exhaust gas recirculation passage 67 is a communicating passage that connects the exhaust gas recirculation passage 22 to the mixing chamber 23. The plurality of exhaust suction apertures 26 is formed in a radial direction with a central axis of the mixing chamber 23 being its center. As a result, a mixing state between the intake air that flows into the interior of the mixing chamber 23 from the air suction passage 21 and the EGR gas that flows from the exhaust gas recirculation passages 22, 67 through the plurality of exhaust suction apertures 26 into the interior of the mixing chamber 23 can be facilitated. Therefore, the high-temperature EGR gas can be efficiently mixed with the low-temperature intake air.

In the present embodiments described above, the nozzle 3 is fitted into and held in an inner circumference of the nozzle receiving part 15 of the housing 2, and the nozzle 3 in turn receives the butterfly valve 4 in such a manner that the butterfly valve 4 can open and close inside the nozzle 3. Alternatively, a generally cylindrical valve receiving part of the housing 2 can directly receive the butterfly valve 4, such that the butterfly valve 4 opens and closes in the valve receiving part. In this case, the nozzle 3 becomes unnecessary, thereby reducing a number of parts and assembling man-hours. Furthermore, in the present embodiments, the butterfly valve 4 of the EGR control valve 1 continuously or gradually adjusts the EGR quantity of the EGR gas in response to each operating state of the engine. The butterfly valve 4 is held and secured to the axial end of the valve shaft 5 by welding or the like. Instead, the butterfly valve 4 can be fixed to the axial end of the valve shaft 5 using screws such as fastening screws, anchoring bolts, and the like.

In the present embodiments, at least the air suction passage 21, the exhaust gas recirculation passage 22, and the mixing chamber 23 are formed inside the single housing 2. The butterfly valve 4 is movably received in the housing 2, in which the electric motor 7 is received and held. As an alternative, the housing can include a first housing part and a second housing part in such a manner that the first housing part and the second housing part are closely joined together to allow heat conduction. The first housing part includes the air suction passage 21 and the mixing chamber 23, and the second housing part includes the butterfly valve 4 and the electric motor 7. That is, although the single housing 2 includes a part of the intake pipe of the internal-combustion engine and a part of the exhaust gas recirculation pipe of the exhaust gas recirculation device in the present embodiments, the housing 2 can alternatively be divided into two housings, namely the first housing part that includes the part of the intake pipe of the internal-combustion engine, and the second housing part that includes the part of the exhaust gas recirculation pipe of the exhaust gas recirculation device. In addition, it is preferable that an area of a contact surface between a first contact surface (a first joining end face) of the first housing part and a second contact surface (a second joining end face) of the second housing part should be sufficiently large. Consequently, the electric motor and the electric motor peripheral parts (the rubber seal such as the oil seal and the packing) can be efficiently cooled down by utilizing the intake air that is suctioned into the internal-combustion engine. Besides, the motor housing (or the cylindrical yoke) of the electric motor 7 can be directly exposed on the inner wall surface of the housing 2 (i.e., on the inner wall surface of the air suction passage 21), or can protrude into the interior of the housing 2.

Additional advantages and modifications will readily occur to those skilled in the art. The invention in its broader terms is therefore not limited to the specific details, representative apparatus, and illustrative examples shown and described.

What is claimed is:

1. An exhaust gas recirculation device comprising:

a housing that has an exhaust gas recirculation passage, through which a part of an exhaust gas of an internal-combustion engine is recirculated from an exhaust side to an intake side of the engine, wherein the housing includes:

a mixing chamber, in which the exhaust gas that is recirculated from the exhaust gas recirculation passage is mixed into an intake air that is suctioned into the engine; and an air suction passage, from which the intake air flows into an interior of the mixing chamber, and which is formed on an upstream side of the mixing chamber in a direction of the intake air flow;

a butterfly valve that is movably received in the housing to open and close the exhaust gas recirculation passage;

a motor that generates driving force, which drives the butterfly valve, wherein the motor is placed adjacent to an inner wall surface of the air suction passage so that the motor is cooled by the intake air that flows through the air suction passage; and a valve driving device that opens and closes the butterfly valve, wherein:

the butterfly valve includes a valve shaft that is rotated by the driving force of the motor;

the butterfly valve is formed integrally with one axial end of the valve shaft;

the valve driving device transmits the driving force of the motor to the valve shaft, and includes a speed reducing mechanism that reduces a rotational speed of the output shaft of the motor; and the motor, the speed reducing mechanism, and the valve shaft are placed adjacent to an inner wall surface of the air suction passage and are arranged one after another in a direction that is parallel to the flow direction of the intake air, which flows through the air suction passage.

2. The exhaust gas recirculation device according to claim 1, wherein the motor includes a heat release part that is exposed on the inner wall surface of the air suction passage so that heat generated from the motor is releasable into the intake air that flows through the air suction passage.

3. The exhaust gas recirculation device according to claim 1, wherein:

the motor is received in the housing; and the housing includes the heat release part that is exposed on the inner wall surface of the air suction passage so that the heat generated from the motor is releasable into the intake air that flows through the air suction passage.

4. The exhaust gas recirculation device according to claim 3, wherein the housing includes a motor housing part, in which a motor receiving hole that receives and holds the motor is formed.

5. The exhaust gas recirculation device according to claim 2, wherein:

the heat release part includes a cooling fin; and the cooling fin protrudes from the inner wall surface of the air suction passage toward a central axis of the air suction passage, to increase an area of a contact surface between the heat release part and the intake air that flows through the air suction passage.

6. The exhaust gas recirculation device according to claim 2, wherein:

the heat release part includes a convex part; and the convex part protrudes from the inner wall surface of the air suction passage toward the central axis of the air suction passage, to increase the area of the contact surface between the heat release part and the intake air that flows through the air suction passage.

7. The exhaust gas recirculation device according to claim 1, wherein:

the motor is received in the housing;

the housing includes a heat release part; and the heat release part is exposed on an outer surface of the housing so that the heat generated from the motor is releasable into air that flows along the outer surface of the housing.

8. The exhaust gas recirculation device according to claim 7, wherein:

the heat release part includes a cooling fin; and the cooling fin protrudes from the outer surface of the housing in a direction away from the air suction passage, to increase an area of a contact surface between the heat release part and the air that flows along the outer surface of the housing.

9. The exhaust gas recirculation device according to claim 1, wherein the mixing chamber includes a plurality of exhaust suction apertures through which the exhaust gas flows into the interior of the mixing chamber from the exhaust gas recirculation passage.

10. The exhaust gas recirculation device according to claim 1, wherein:

the housing includes an air delivery passage, through which the intake air flows out of the mixing chamber toward the internal-combustion engine; and the air suction passage, the exhaust gas recirculation passage, and the air delivery passage are interconnected by the mixing chamber to form a three-way passage having a T-shaped cross section.

11. The exhaust gas recirculation device according to claim 1, wherein:

the mixing chamber includes the exhaust suction aperture, through which the exhaust gas flows into the interior of the mixing chamber from the exhaust gas recirculation passage;

the housing includes a weir on an opening edge of the exhaust suction aperture to limit a backflow of the exhaust gas toward the air suction passage; and the weir is formed on an upstream side of the exhaust suction aperture in the direction of the intake air flow, and protrudes from the opening edge of the exhaust suction aperture toward the central axis of the air suction passage.

12. The exhaust gas recirculation device according to claim 1, wherein:

the housing includes a valve bearing part;

the valve bearing part rotatably supports the valve shaft; and the valve bearing part is placed on one of:

an air suction passage side of an output shaft of the motor; and a mixing chamber side of the output shaft of the motor.

13. The exhaust gas recirculation device according to claim 1, wherein:

the housing includes a first housing part and a second housing part;

the second housing part closely contacts the first housing part to allow heat conduction therebetween;

the first housing part includes the mixing chamber and the air suction passage; and the motor and the butterfly valve are received in the second housing part.

14. The exhaust gas recirculation device according to claim 1, wherein:

the motor is entirely placed on an upstream side of an outlet opening of the exhaust gas recirculation passage with respect to the direction of the intake air flow; and the motor is placed on one lateral side of the air suction passage where the outlet opening of the exhaust gas recirculation passage exists.

15. The exhaust gas recirculation device according to claim 1, wherein:

the motor, the speed reducing mechanism, and the valve shaft are provided at a location which is adjacent to a corner where the air suction passage meets the exhaust gas recirculation passage; and the motor, the speed reducing mechanism, and the valve shaft are arranged one after another in this order toward the exhaust gas recirculation passage in the direction that is parallel to the flow direction of the intake air.

16. An exhaust gas recirculation device comprising:

a housing that has an exhaust gas recirculation passage, through which a part of an exhaust gas of an internal-combustion engine is recirculated from an exhaust side to an intake side of the engine, wherein the housing includes:

a mixing chamber, in which the exhaust gas that is recirculated from the exhaust gas recirculation passage is mixed into an intake air that is suctioned into the engine; and an air suction passage, from which the intake air flows into an interior of the mixing chamber, and which is formed on an upstream side of the mixing chamber in a direction of the intake air flow;

a butterfly valve that is movably received in the housing to open and close the exhaust gas recirculation passage; and a motor that generates driving force, which drives the butterfly valve, wherein the motor is placed adjacent to an inner wall surface of the air suction passage so that the motor is cooled by the intake air that flows through the air suction passage, wherein:

the motor includes a heat release part that is exposed on the inner wall surface of the air suction passage so that heat generated from the motor is releasable into the intake air that flows through the air suction passage;

the heat release part includes a cooling fin; and the cooling fin protrudes from the inner wall surface of the air suction passage toward a central axis of the air suction passage, to increase an area of a contact surface between the heat release part and the intake air that flows through the air suction passage.

17. An exhaust gas recirculation device comprising:

a housing that has an exhaust gas recirculation passage, through which a part of an exhaust gas of an internal-combustion engine is recirculated from an exhaust side to an intake side of the engine, wherein the housing includes:

a mixing chamber, in which the exhaust gas that is recirculated from the exhaust gas recirculation passage is mixed into an intake air that is suctioned into the engine; and an air suction passage, from which the intake air flows into an interior of the mixing chamber, and which is formed on an upstream side of the mixing chamber in a direction of the intake air flow;

a butterfly valve that is movably received in the housing to open and close the exhaust gas recirculation passage; and a motor that generates driving force, which drives the butterfly valve, wherein the motor is placed adjacent to an inner wall surface of the air suction passage so that the motor is cooled by the intake air that flows through the air suction passage, wherein:

the motor includes a heat release part that is exposed on the inner wall surface of the air suction passage so that heat generated from the motor is releasable into the intake air that flows through the air suction passage;

the heat release part includes a convex part; and the convex part protrudes from the inner wall surface of the air suction passage toward the central axis of the air suction passage, to increase the area of the contact surface between the heat release part and the intake air that flows through the air suction passage.

18. An exhaust gas recirculation device comprising:

a housing that has an exhaust gas recirculation passage, through which a part of an exhaust gas of an internal-combustion engine is recirculated from an exhaust side to an intake side of the engine, wherein the housing includes:

a mixing chamber, in which the exhaust gas that is recirculated from the exhaust gas recirculation passage is mixed into an intake air that is suctioned into the engine; and an air suction passage, from which the intake air flows into an interior of the mixing chamber, and which is formed on an upstream side of the mixing chamber in a direction of the intake air flow;

a butterfly valve that is movably received in the housing to open and close the exhaust gas recirculation passage; and a motor that generates driving force, which drives the butterfly valve, wherein the motor is placed adjacent to an inner wall surface of the air suction passage so that the motor is cooled by the intake air that flows through the air suction passage, wherein:

the motor is received in the housing;

the housing includes a heat release part;

the heat release part is exposed on an outer surface of the housing so that the heat generated from the motor is releasable into air that flows along the outer surface of the housing;

the heat release part includes a cooling fin; and the cooling fin protrudes from the outer surface of the housing in a direction away from the air suction passage, to increase an area of a contact surface between the heat release part and the air that flows along the outer surface of the housing.

19. An exhaust gas recirculation device comprising:

a housing that has an exhaust gas recirculation passage, through which a part of an exhaust gas of an internal-combustion engine is recirculated from an exhaust side to an intake side of the engine, wherein the housing includes:

a mixing chamber, in which the exhaust gas that is recirculated from the exhaust gas recirculation passage is mixed into an intake air that is suctioned into the engine; and an air suction passage, from which the intake air flows into an interior of the mixing chamber, and which is formed on an upstream side of the mixing chamber in a direction of the intake air flow;

a butterfly valve that is movably received in the housing to open and close the exhaust gas recirculation passage; and a motor that generates driving force, which drives the butterfly valve, wherein the motor is placed adjacent to an inner wall surface of the air suction passage so that the motor is cooled by the intake air that flows through the air suction passage, wherein:

the mixing chamber includes the exhaust suction aperture, through which the exhaust gas flows into the interior of the mixing chamber from the exhaust gas recirculation passage;

the housing includes a weir on an opening edge of the exhaust suction aperture to limit a backflow of the exhaust gas toward the air suction passage; and the weir is formed on an upstream side of the exhaust suction aperture in the direction of the intake air flow, and protrudes from the opening edge of the exhaust suction aperture toward the central axis of the air suction passage.

* * * * *